US010519737B2

(12) United States Patent
Duphorne et al.

(10) Patent No.: US 10,519,737 B2
(45) Date of Patent: Dec. 31, 2019

(54) PLACE-N-PERF

(71) Applicant: Baker Hughes, a GE company, LLC, Houston, TX (US)

(72) Inventors: Darin H. Duphorne, Houston, TX (US); James Scott Sanchez, Tomball, TX (US); André J. Porter, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 87 days.

(21) Appl. No.: 15/825,383

(22) Filed: Nov. 29, 2017

(65) Prior Publication Data

US 2019/0162037 A1 May 30, 2019

(51) Int. Cl.

| | |
|---|---|
| ***E21B 43/112*** | (2006.01) |
| ***E21B 49/06*** | (2006.01) |
| ***E21B 29/06*** | (2006.01) |
| ***E21B 43/26*** | (2006.01) |
| ***E21B 33/124*** | (2006.01) |
| ***E21B 7/06*** | (2006.01) |

(52) U.S. Cl.
CPC ..... *E21B 29/06* (2013.01); *E21B 7/06* (2013.01); *E21B 33/124* (2013.01); *E21B 43/26* (2013.01)

(58) Field of Classification Search
CPC ..... E21B 7/061; E21B 43/112; E21B 10/66; E21B 49/06
See application file for complete search history.

(56) References Cited

U.S. PATENT DOCUMENTS 2,344,598 A * 3/1944 Church ..... E21B 49/06 175/268
2,526,695 A * 10/1950 Schlumberger ..... E21B 33/138 166/100
2,638,801 A * 5/1953 Klaasen ..... E21B 43/112 166/237
3,062,294 A * 11/1962 Huitt ..... E21B 43/112 166/177.5
3,191,697 A * 6/1965 Haines ..... C09K 8/72 175/424
3,797,576 A * 3/1974 Azalbert ..... E21B 4/00 166/169
4,084,639 A * 4/1978 Todd ..... E21B 7/04 166/248
4,185,705 A * 1/1980 Bullard ..... E21B 4/16 175/78

(Continued)

*Primary Examiner* — Kipp C Wallace
(74) *Attorney, Agent, or Firm* — Parsons Behle & Latimer

(57) ABSTRACT

A bottom hole assembly (BHA) and methods of using the BHA, the BHA having at least one tool configured to move between the interior and the exterior by fluid pumped down a string. The tool is configured to create a hole in a wellbore tubular, such as casing, tubing, or a liner. The BHA includes a ramp positioned adjacent to the tool to guide the tool to engage the tubular. The tool may be a mill configured to cut a hole in the tubular or a punch member configured to punch a hole in the tubular. A packing element of the BHA enables fluid to be pumped down the annulus and through the hole to treat and/or fracture the formation. The tool may be positioned between two packing elements and fluid may be pumped down the string and through a portion of the tool to treat and/or fracture the formation.

20 Claims, 9 Drawing Sheets

(56) References Cited

U.S. PATENT DOCUMENTS

| | | | | |
|---|---|---|---|---|
| 4,640,353 | A * | 2/1987 | Schuh | E21B 7/061 166/117.6 |
| 4,790,384 | A * | 12/1988 | Schellstede | E21B 7/061 166/223 |
| 6,276,453 | B1 * | 8/2001 | Bond | E21B 1/00 166/313 |
| 10,174,557 | B2 * | 1/2019 | Freyer | E21B 23/08 |
| 2002/0005286 | A1 * | 1/2002 | Mazorow | E21B 7/061 166/255.3 |
| 2009/0194277 | A1 * | 8/2009 | Burnett | E21B 23/00 166/255.1 |
| 2011/0017445 | A1 * | 1/2011 | Freyer | E21B 7/061 166/222 |
| 2015/0041137 | A1 * | 2/2015 | Rodriguez | E21B 4/04 166/301 |
| 2016/0160568 | A1 * | 6/2016 | Randall | E21B 7/061 175/26 |
| 2017/0030157 | A1 * | 2/2017 | Hansen | E21B 49/081 |
| 2017/0152727 | A1 * | 6/2017 | Head | E21B 41/0035 |

* cited by examiner

PLACE-N-PERF

BACKGROUND

Field of the Disclosure

The embodiments described herein relate to a bottom hole assembly (BHA) and methods of using the BHA, the BHA having tool configured to move from the interior of the BHA to the exterior of the BHA from fluid pumped down a string to the BHA. The tool is configured to create at least one hole in a casing, a tubing, or a liner of a wellbore. The BHA includes a ramp positioned adjacent to the tool to guide the tool to engage with the casing, the tubing, or the liner of the wellbore.

Description of the Related Art

Oil and gas well completions are commonly performed after drilling hydrocarbon-producing wellbores. Part of the completion process includes running casing into the wellbore. The well casing assembly may be set in the wellbore by various techniques, such as, filling the annular space between the wellbore and the outer diameter of the casing with cement.

After the casing is set in the well hole, perforating and fracturing operations may be performed. Generally, perforating involves forming openings through the casing and cement to permit access to the wellbore formation. Perforations in the casing may be made by various devices such as a perforating gun or a sand jet perforator. Thereafter, the perforated zone may be hydraulically isolated and fracturing operations are performed.

Techniques have been developed whereby perforating and fracturing operations are performed with a coiled tubing string. One such technique is known as the annular coil tubing fracturing process, which typically uses a perforating device that contains multiple shaped charges used to create perforations. In some applications, the use of a perforating charges may not be desirable.

Sand jet perforating is a perforation procedure that uses a sand slurry to blast holes through the casing, the cement and into the well formation. One of the issues with sand jet perforating is that sand from the perforating process may remain in the well bore annulus, which may potentially interfere with the fracturing process. Therefore, in some cases, it may be desirable to clean the sand out of the well bore, which can be a lengthy process requiring one or more hours per production zone in the well.

Other disadvantages may exist.

SUMMARY

The present disclosure is directed to a BHA having a tool configured to move from the interior of the BHA to the exterior of the BHA from fluid pumped down a string to the BHA. The tool is configured to create at least one hole in a casing, a tubing, or a liner (collectively referred to herein as "a tubular") of a wellbore. The BHA includes a ramp positioned adjacent to the tool to guide the tool to engage with the tubular of the wellbore.

An embodiment of the present disclosure is a BHA comprising a housing, at least one tool positioned within an interior of the housing, the at least one tool configured to selectively move from the interior of the housing through an opening in the housing, and a sub connected to a portion of the housing, the sub having a ramp positioned adjacent to the opening in the housing. The tool being configured to create at least one hole in a tubular of a wellbore. The BHA includes at least one packing element configured to selectively isolate a portion of a wellbore. Fluid pressure within the interior of the housing causes the at least one tool to move through the opening in the housing and the ramp is configured to guide the at least one tool to engage a portion of the tubular of the wellbore to create the at least one hole in the tubular.

The tool may be a punch member. The BHA may include a second packing element with the punch member positioned between the at least one packing element and the second packing element. The at least one packing element and the second packing element may be configured to isolate a portion of the wellbore between the two packing elements. The at least one punch member may be configured to permit fluid to be pumped out of an end of the at least one punch member.

The ramp may be comprised of a material that is harder than the tubular. The at least one tool may be a mill having at least one cutter. The ramp may be configured to engage an arm connected to the at least one cutter to guide the at least one cutter to engage the portion of the tubular. Fluid pumped down coiled tubing connect to the housing of the BHA may cause the at least one tool to move through the opening in the housing. The BHA may include a plurality of tools positioned within the interior, each of the tools being configured to selectively move from the interior through an opening in the housing with the ramp being configured to guide each of the tools to engage a portion of the tubular to create a plurality of holes in the tubular. The plurality of tools may be a plurality of mills or a plurality of punch members.

An embodiment of the present disclosure is a method comprising positioning a BHA within a wellbore and moving at least one tool from an interior of the BHA to an exterior of the BHA by pumping fluid down a coiled tubing string to the BHA. The method comprises guiding the at least one tool with a ramp as the at least one tool moves from the interior to the exterior. The method comprises creating at least one hole through a casing, a tubing, or a liner (collectively referred to herein as "a tubular") of the wellbore with the at least one tool.

The fluid pumped down the coiled tubing string may comprise mud. The tool may comprises a punch member and creating the at least one hole may comprise punching the at least one hole in the tubular with the punch member. The method may include pumping fluid through the punch member to a formation of the wellbore through the at least one hole in the tubular. The method may include fracturing the formation by pumping fluid through the punch member.

The at least one tool may comprise a mill, and creating the at least one hole through the tubular may comprise cutting the at least one hole through the tubular with the mill. The method may include moving the mill back to the interior of the BHA after creating the at least one hole through the tubular. The method may include pumping fluid through the at least one hole through the tubular to a formation of the wellbore after moving the mill back to the interior of the BHA.

An embodiment of the present disclosure is a downhole system comprising a tubing string, a housing connected to the tubing string, an interior of the housing in fluid communication with an interior of the tubing string, and a plurality of tools movable between the interior of the housing and an exterior of the housing, wherein each of the plurality of tools is configured to create a hole in a casing, a tubing, or a liner (collectively referred herein as "a tubular") of a wellbore. The system comprises a sub having an external ramp, the external ramp positioned adjacent to the plurality of tools, the external ramp being configured to cause each of the plurality of tools to engage a portion of the tubular as each of the plurality of tools moves from the interior to the exterior of the housing. Fluid pumped down the tubing string moves the plurality of tools from the interior of the housing to engage the tubular. The plurality of tools may comprising a plurality of mills configured to cut holes in the tubular or a plurality of punch members configured to punch holes in the tubular.

Figure 1:
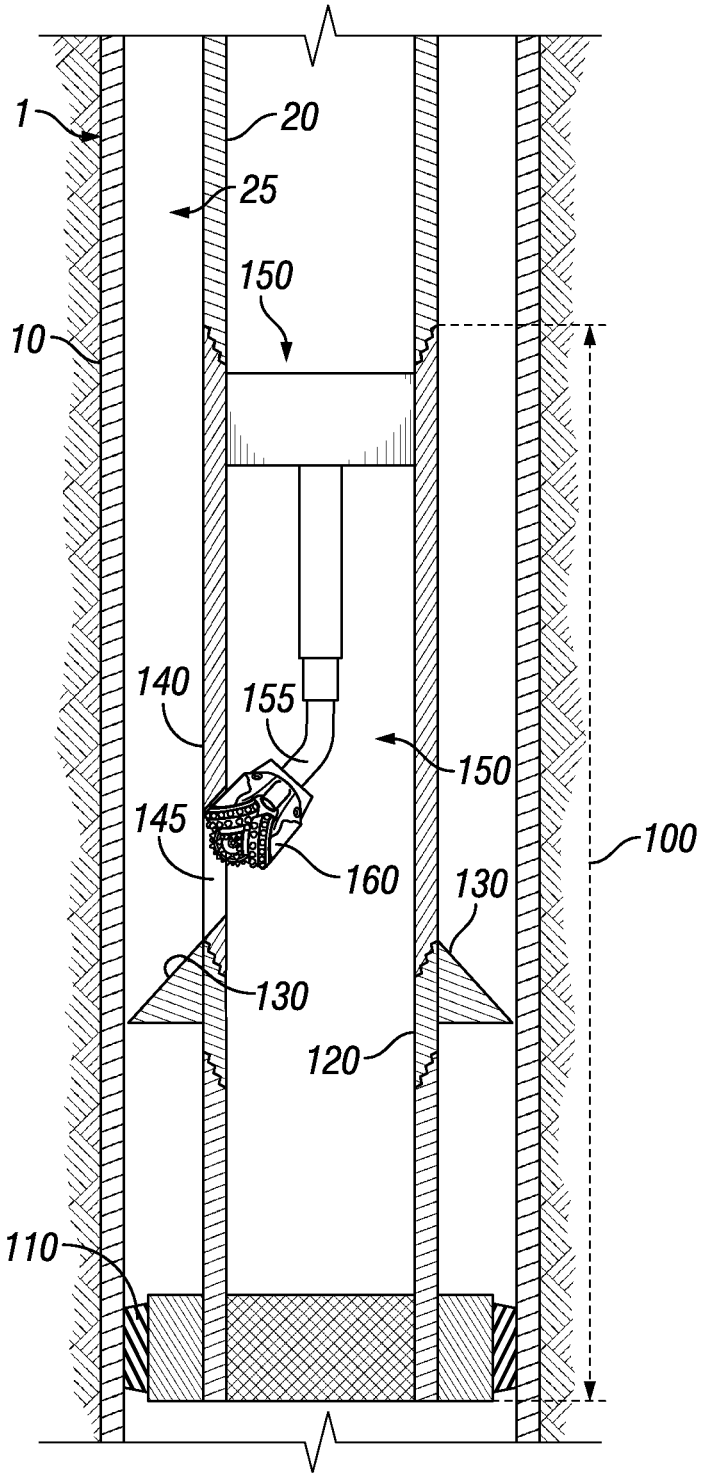
FIG. 1 shows an embodiment of BHA with a tool positioned within an interior of the BHA, the tool being configured to create at least one hole in a tubular of a wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of BHA 100 with a tool positioned within an interior of the BHA 100, the tool being configured to create a hole in a tubular, casing 10, of a wellbore 1. The tool is configured to create a hole in various wellbore tubulars including, but not limited to, casing, tubing, and liners. In one embodiment the tool is a mill, 150 positioned within an interior of the BHA 100. The BHA 100 includes a housing 140 connected to a coiled tubing string 20. The mill 150 includes a cutter 160 positioned on the end of an arm 155. The housing 140 includes at least one opening 145 that permits the cutter 160 of the mill 150 to be moved from the interior of the housing 140. The BHA 100 includes a sub 120 connected to the downhole end of the housing 140 and the sub 120 includes a ramp 130 connected to exterior of the sub 120. The external ramp 130 may be integral to the sub 120 as would be appreciated by one of ordinary skill in the art having the benefit of this disclosure. The sub 120 and external ramp 130 may be formed as an integral part of the housing 140 as would be appreciated by one of ordinary skill in the art having the benefit of this disclosure. The BHA 100 may also include a packing element 110 connected to the sub 120. The packing element 110 may be actuated to isolate a portion of the wellbore 1. For example, the packing element 110 may isolate a portion of an annulus 25 between the casing 10 of the wellbore 1 and the coiled tubing string 25.

The coiled tubing string 20 may be used to position the BHA 100 at a desired location within a wellbore 1 at which it is desired to create at least one hole in the casing 10 of the wellbore 1. The BHA 100 of FIG. 1 is shown within a casing 10 for illustrative purposes and may be positioned within various wellbore tubulars as would be appreciated by one of ordinary skill in the art having the benefit of this disclosure. After being positioned at a desired location, the packing element 110 may be actuated to seal off a portion of the wellbore 1. The tool configured to create a hole in the casing 10, which may be a mill 150 having a cutter 160 positioned at the end of an arm 155, may then be actuated to move out of the opening 145 in the housing 140 to create a hole in the casing 10, as described herein.

Figure 2:
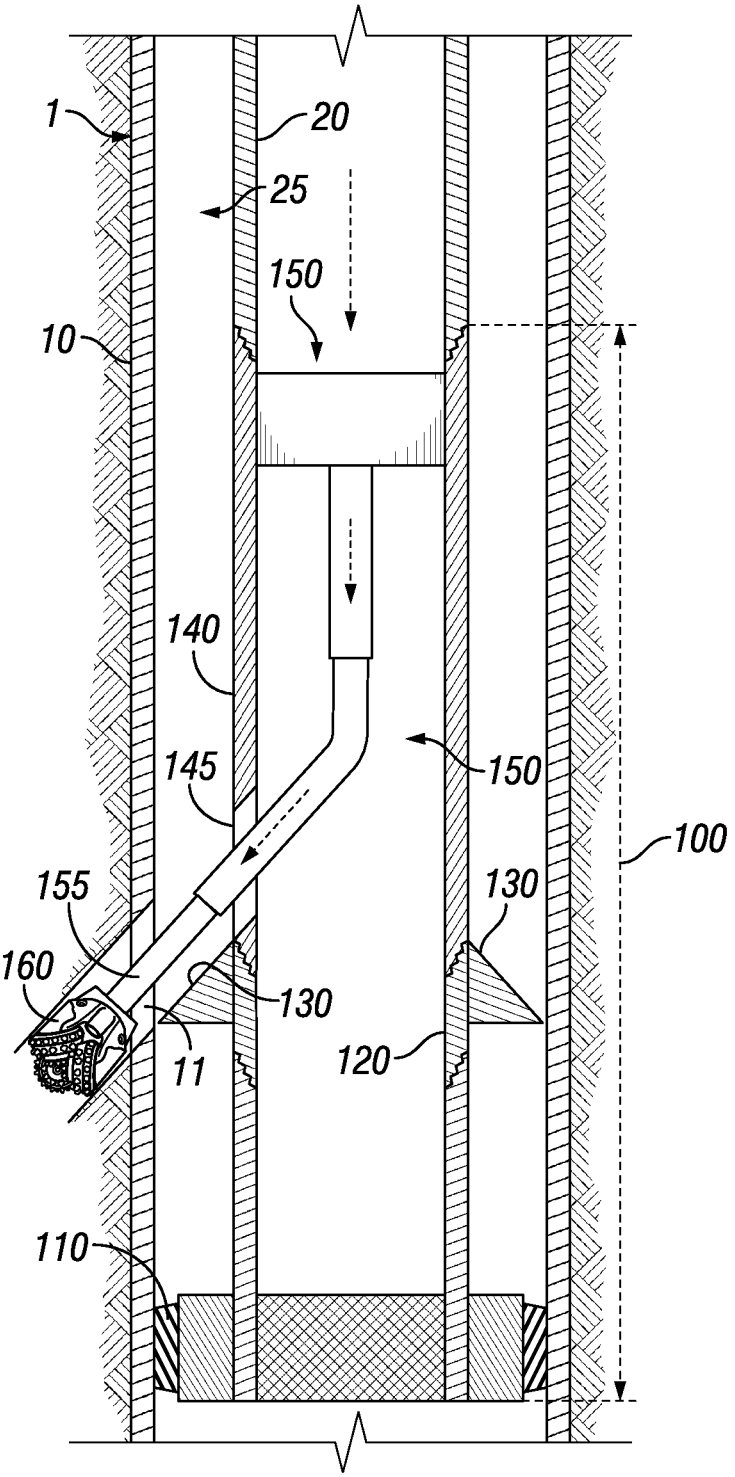
FIG. 2 shows the BHA of FIG. 1 with the tool moved to the exterior of the BHA engaged with the tubular of the wellbore to create at least one hole in the casing.

FIG. 2 shows the arm 155 of the mill 150 extended to cut a hole 11 in the casing 10 with the cutter 160. FIG. 2 shows a hole 11 in the casing 10 for illustrative purposes and the cutter 160 may be used to cut a hole a various tubulars of a wellbore, such as a liner or tubing, as would be appreciated by one of ordinary skill in the art having the benefit of this disclosure. The arm 155 and cutter 160 may be actuated by pumping fluid down the tubing string 25 as indicated by the arrow above the mill 150. The fluid pumped down the wellbore, as indicated by the arrows shown in FIG. 2, may actuate the cutter 160 as well as cause the arm 155 to extend. The ramp 130 positioned adjacent to the opening 145 is configured to guide the cutter 160 to engage the casing 10. The ramp 130 may be comprised of a harder material than the casing 10 enabling the ramp 130 to guide the cutter 160 to engage the casing 10 without damaging the ramp 130. Alternatively, the ramp 130 may be configured to guide the arm 155 of the mill 150 to cause the cutter 160 to engage the casing 10 as would be appreciated by one of ordinary skill in the art having the benefit of this disclosure. Various mechanisms may be used to extend the cutting tool, or mill 150, from the interior of the housing 140 of the BHA 100 as would be appreciated by one of ordinary skill in the art having the benefit of this disclosure. For example, but not limited to, fluid pressure within the tubing string 20 may cause the downward movement of a tool causing it to extend out of an opening or a control line may be used to actuate the cutting tool, as discussed herein.

Figure 3:
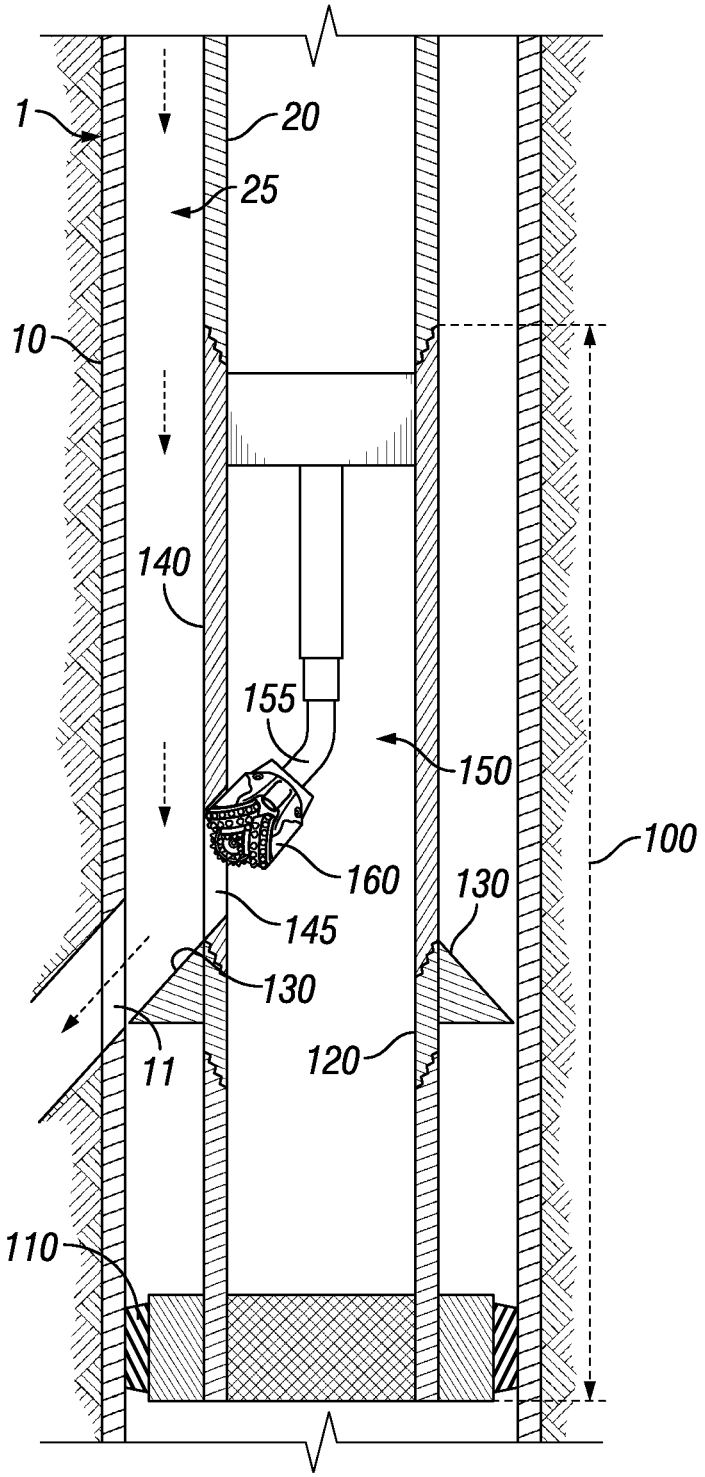
FIG. 3 shows the BHA of FIG. 1 with the tool moved back to the interior of the BHA after creating a hole in the tubular.

After creating a hole 11 in the casing 10, the cutter 160 may be retracted into the housing 140 of the BHA 100 through the opening 145, as shown in FIG. 3. Once the cutting tool 160 has been retracted, the wellbore 1 may be treated and/or fractured through the hole 11 in the casing 10 by pumping fluid down the annulus 25, as shown by the arrows in FIG. 3. The packer 110 may be unset and the BHA 100 may be moved to another location within the wellbore 1 that needs to be treated and/or fractured. The BHA 100 of FIGS. 1-3 is shown having a single cutter 160 and opening 145 for illustrative purposes. However, the number, size, configuration, location, and/or shape of the cutter 160, arm 155, opening 145, ramp 130, and packer element 110 may be varied depending on the application as would be appreciated by one of ordinary skill in the art having the benefit of this disclosure.

Figure 4:
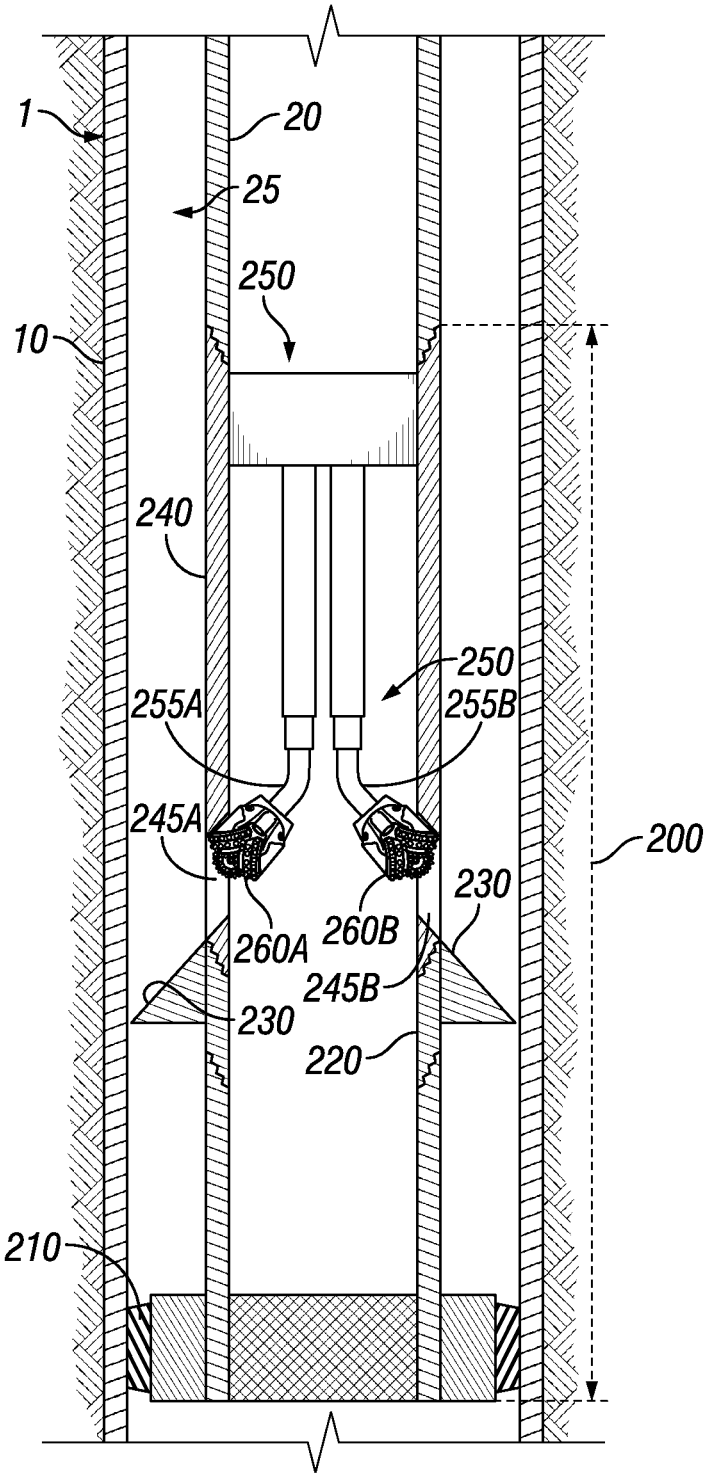
FIG. 4 shows an embodiment of a BHA having multiple tools configured to move from the interior to the exterior to create a plurality of holes in a tubular of a wellbore.

FIG. 4 shows an embodiment of BHA 200 having a tool configured to create at least one hole in a wellbore tubular, casing 10, the tool being positioned within an interior of the housing 240 of the BHA 200. The tool may be a mill 250 having two cutters 260A, 260B each positioned on the end of an arm 255A, 255B. The cutters 260A, 260B are configured to cut a hole in the casing 10 of a wellbore 1. The BHA 200 includes a housing 240 connected to a coiled tubing string 20. The housing 240 includes two openings 245A, 245B each that permits one of the cutters 260A, 260B of the mill 250 to be moved from the interior of the housing 240 to engage the casing 10. The BHA 200 includes a sub 220 connected to the downhole end of the housing 240. The sub 220 includes an external ramp 230 configured to guide the cutters 260A, 260B to engage and cut a hole in the casing 10, as discussed herein. The BHA 200 may also include a packing element 210 connected to the sub 120, which may be actuated to isolate a portion of the wellbore 1.

As discussed herein, the coiled tubing string 20 may be used to position the BHA 200 at a desired location within a wellbore 1 at which it is desired to create holes in the casing 10 of the wellbore 1. After being positioned at a desired location, the packing element 210 may be actuated to seal off a portion of the wellbore 1. Fluid may then be pumped down the tubing string 25 to actuated the mill 250 to move the cutters 260A, 260B out of the openings 245A, 245B in the housing 240 to create holes in the casing 10.

Figure 5:
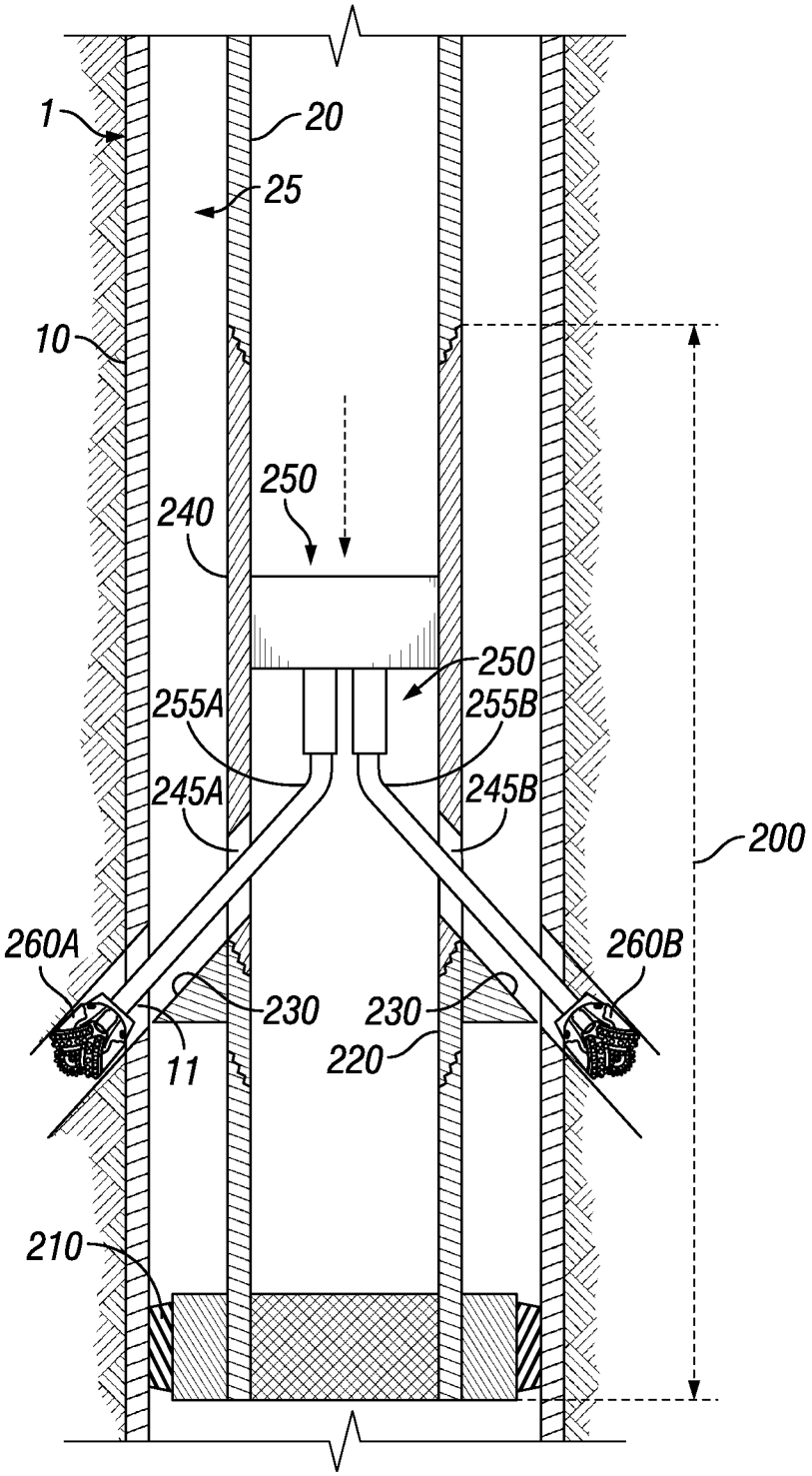
FIG. 5 shows the BHA of FIG. 4 with the tools extended from the BHA to create holes within the tubular of the wellbore.

FIG. 5 shows fluid pumped down the tubing string 25, as indicated by the arrow, moving the mill 250 downward within the housing 240 of the BHA 200. The downward movement of the mill 250 causes the cutters 260A, 260B to move out of the housing 240 through the openings 245A, 245B to cut holes 11 in the casing 10 with the cutters 260A, 260B. The ramp 230 positioned adjacent to the openings 245A, 245B is configured to guide the cutters 260A, 260B to engage the casing 10 and create the openings 11. FIG. 5 shows holes 11 in the casing 10 for illustrative purposes and the cutters 260A, 260B may be used to cut holes in various wellbore tubulars, such as a liner, casing, or tubing, as would be appreciated by one of ordinary skill in the art having the benefit of this disclosure. The BHA 200 of FIGS. 4 and 5 is shown with two cutters 260A, 260B for illustrative purposes. However, the number, shape, size, and/or location of cutters 260A, 260B may be varied depending on the application as would be appreciated by one of ordinary skill in the art. For example, the BHA 200 may include three, four, or more cutters.

Figure 6:
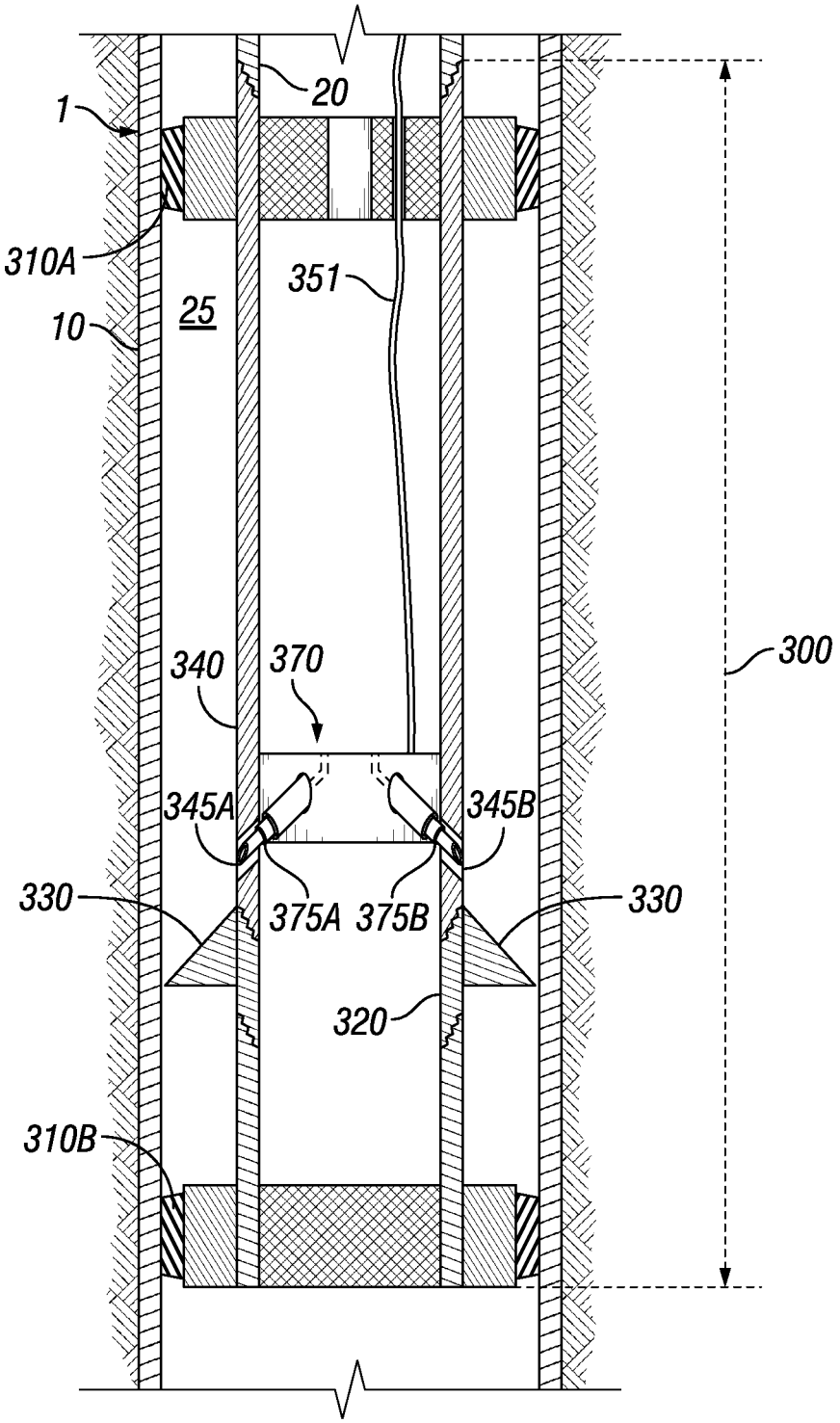
FIG. 6 shows an embodiment of a BHA having tools configured to create at least one hole in a tubular of a wellbore, the tools being positioned between two packing elements of the BHA.

FIG. 6 shows an embodiment of BHA 300 with a tool configured to create a hole in a tubular, casing 10, of a wellbore 1. In one embodiment the tool comprises punch device 370 that includes two punch members 375A, 375B positioned within an interior of the BHA 300, the punch device 370 being configured to create holes in the casing 10 of the wellbore 1 by the extension of the punch members 375A, 375B. The BHA 300 includes a housing 340 connected to a coiled tubing string 20. The housing 340 includes openings 345A, 345B that permit the punch members 375A, 375B to be moved from the interior of the housing 340 to engage the casing 10. The BHA 300 includes a sub 320 connected to the downhole end of the housing 340. The sub 320 includes a ramp 330 on the exterior of the sub 320. The external ramp 330 may be integral to the sub 320 as would be appreciated by one of ordinary skill in the art having the benefit of this disclosure. The sub 320 and external ramp 330 may be formed as an integral part of the housing 340 as would be appreciated by one of ordinary skill in the art having the benefit of this disclosure. The BHA 300 may also include an upper packing element 310A and a lower packing element 310B, which may be actuated to isolate the annulus 25 between the packing elements 310A, 310B.

Figure 7:
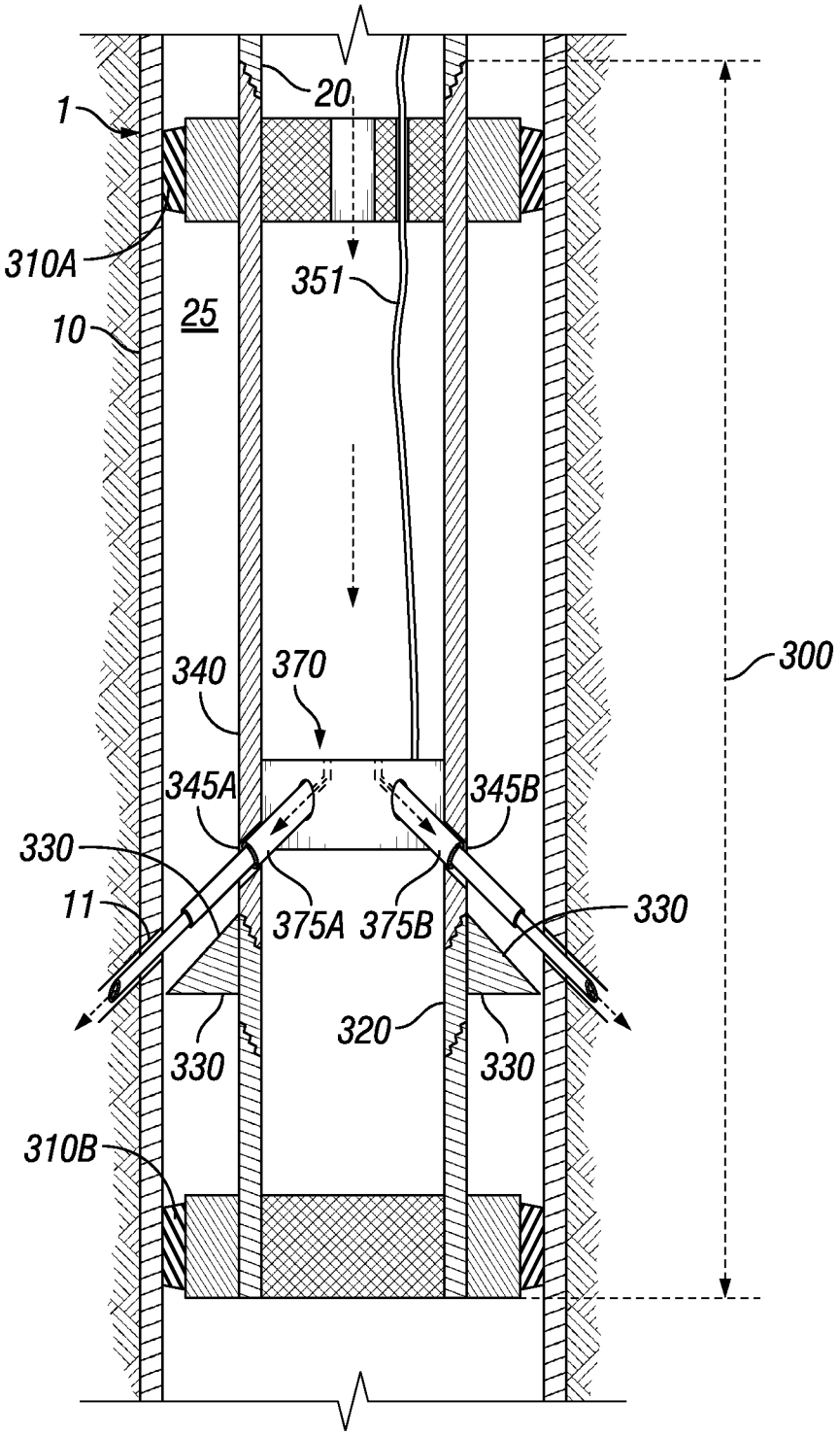
FIG. 7 shows the BHA of FIG. 6 with the tools punching holes in the wellbore tubular and pumping fluid through the tools to a formation of the wellbore.

FIG. 7 shows the punch members 375A, 375B extended to create holes 11 in the casing 10 of the wellbore 1. FIG. 7 shows holes 11 in the casing 10 for illustrative purposes and the punch members 375A, 375B may be used to create holes a various wellbore tubulars, such as a liner, tubing, or casing, of a wellbore as would be appreciated by one of ordinary skill in the art having the benefit of this disclosure. A control line 351 may be connected to the punch device 370. The control line 351 may be a hydraulic control line used to actuate the punch members 375A, 375B. Alternatively, an electrical signal may be transmitted down the control line 351 to control the actuation of the punch members 375A, 375B as would be appreciated by one of ordinary skill in the art having the benefit of this disclosure. As discussed herein, the ramp 330 may be positioned adjacent to the openings 345A, 345B and may be configured to guide the punch members 375A, 375B to engage the casing 10. The punch members 375A, 375B may be configured to permit the pumping and/or injection of fluid through the punch members 375A, 375B and into the formation as indicated by the arrows shown in FIG. 7. The punch members 375A, 375B may be used to create holes 11 in the casing 10 and then treat and/or fracture the formation of the wellbore through the punch members 375A, 375B while still extended from the housing 340 of the BHA 300.

Figure 8:
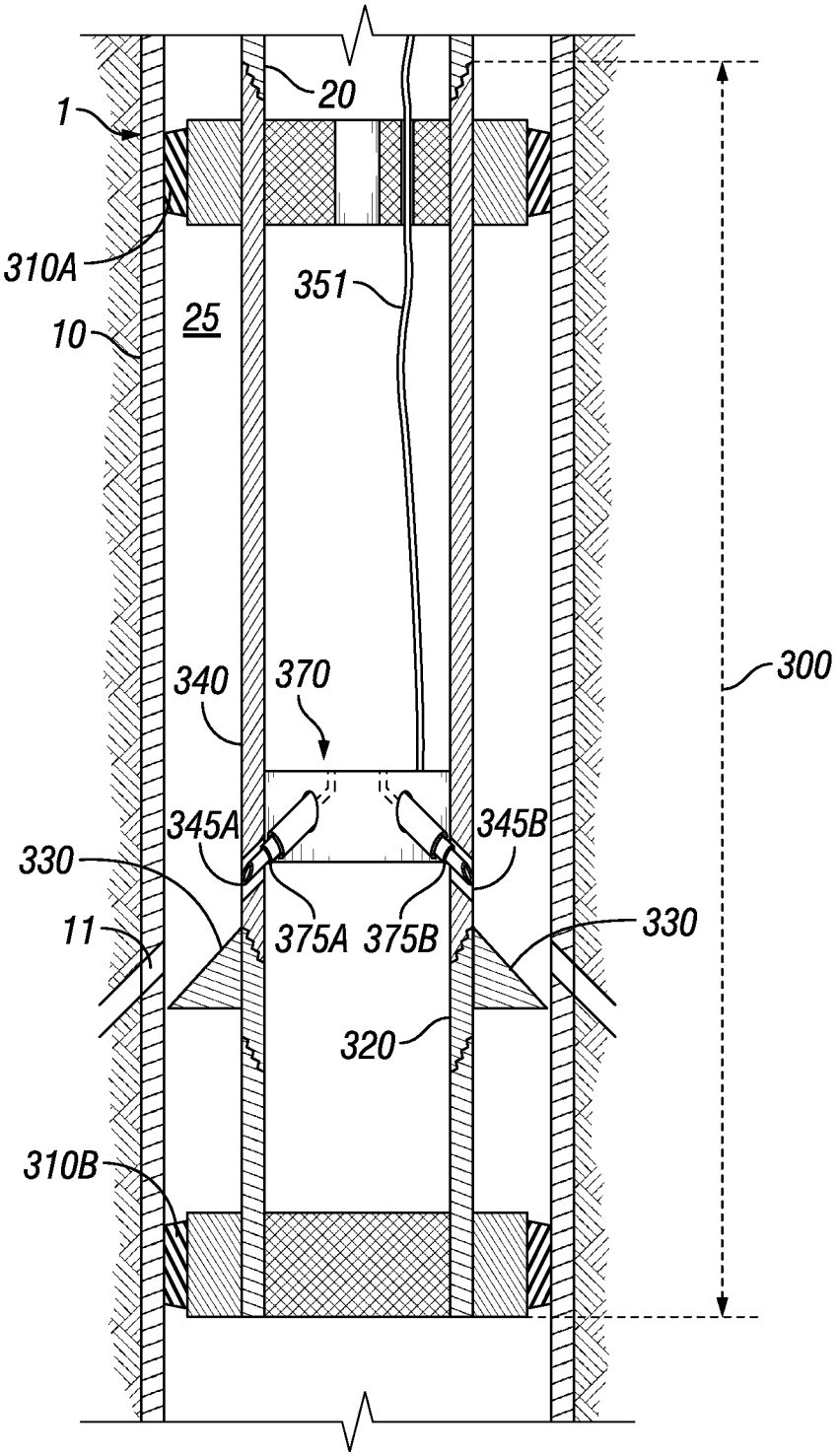
FIG. 8 shows the BHA of FIG. 6 with the tools retracted inside of the BHA after punching holes in the tubular of the wellbore.

The punch members 375A, 375B may be retracted into the housing 340 of the BHA 300 through the openings 345A, 345B as shown in FIG. 8. Once the punch members 375A, 375B have been retracted, the packing elements 310A, 310B may be unset and the BHA 300 may be moved to another location within the wellbore 1 that needs to be treated and/or fractured. The BHA 300 of FIGS. 6-8 is shown having two punch members 375A, 375B and two openings 345A, 345B for illustrative purposes. However, the number, size, configuration, location, and/or shape of the punch members 375A, 375B, openings 345A, 345B, ramp 330, and packer elements 310A, 310B may be varied depending on the application as would be appreciated by one of ordinary skill in the art having the benefit of this disclosure.

Figure 9:
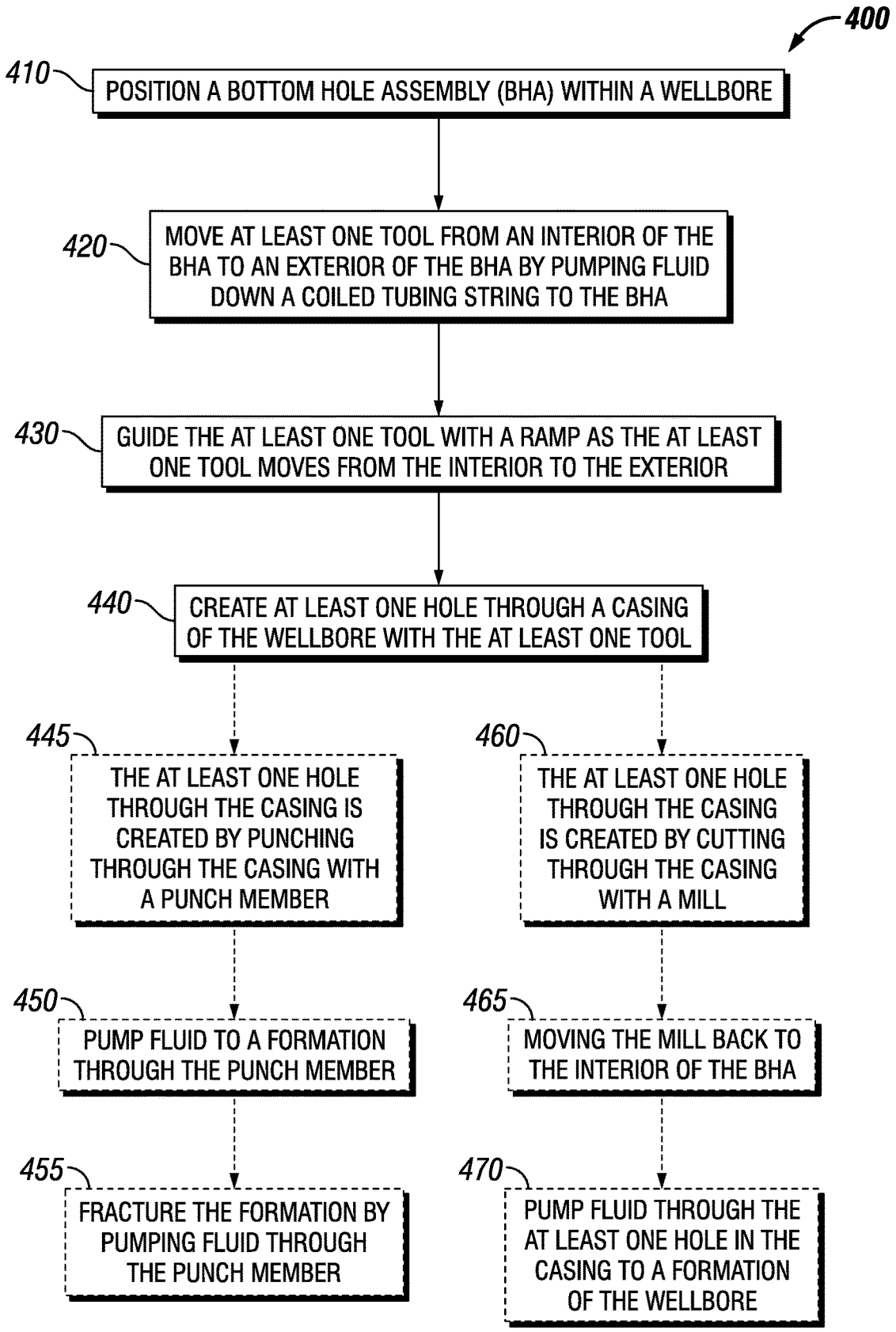
FIG. 9 is a flow chart of an embodiment of a method disclosed herein.

FIG. 9 is a flow chart of an embodiment of a method 400 of using a BHA in a wellbore. The method 400 includes positioning a BHA within a wellbore, at step 410. The method 400 includes moving at least one tool from an interior of the BHA to an exterior of the BHA by pumping fluid down a coiled tubing string to the BHA, at step 420. At step 430, the method 400 includes guiding the at least one tool with a ramp as the at least one tool moves from the interior of the BHA to the exterior of the BHA. The tool is configured to create at least one hole in a casing of the wellbore. For example, the tool may be, but is not limited to, a mill having a cutter or a punch member. The method 400 includes creating at least one hole through a casing of the wellbore with the at least one tool, at step 440. As discussed herein, the BHA may include multiple tools positioned within its interior that are configured to create multiple holes in a casing upon moving from the interior of the BHA to the exterior of the BHA.

The method 400 may include creating the at least one hole through the casing by punching through the casing with a punch member, at step 445. Fluid may be pumped to a formation through the punch member, at step 450. The method 400 may include fracturing the formation by pumping fluid through the punch member, at step 455.

The method 400 may include creating the at least one hole through the casing by cutting through the casing with a mill, at step 460. The method 400 may include moving the mil back to the interior of the BHA, at step 465, and pumping fluid through the at least one hole in the casing to a formation, at step 470. Disclosed herein is a method that creates a hole through a casing of a wellbore by guiding a tool from an interior of a BHA with a ramp positioned adjacent to an opening in a housing of the BHA.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A bottom hole assembly (BHA) comprising:

a housing;

at least one tool positioned within an interior of the housing, the at least one tool configured to selectively move from the interior of the housing through an opening in the housing and configured to create at least one hole in a tubular of a wellbore;

a sub connected to a portion of the housing, the sub having a ramp positioned adjacent to the opening in the housing, the ramp being positioned below the opening in the housing in an annulus between the housing and the tubular of the wellbore: and at least one packing element configured to selectively isolate a portion of a wellbore; wherein fluid pressure within the interior of the housing causes the at least one tool to move through the opening in the housing, wherein the ramp is configured to guide the at least one tool to engage a portion of the tubular of the wellbore to create the at least one hole in the tubular.

2. The BHA of claim 1, wherein the at least one tool comprises a punch member.

3. The BHA of claim 2, further comprising a second packing element, wherein the at least one punch member is positioned between the at least one packing element and the second packing element, the at least one packing element and the second packing element being configured to isolate a portion of the wellbore between the at least one packing element and the second packing element.

4. The BHA of claim 3, the at least one punch member is configured to permit fluid to be pumped out of an end of the at least one punch member.

5. The BHA of claim 1, wherein the ramp comprises a material that is harder than the tubular.

6. The BHA of claim 1, wherein the at least one tool comprises a mill comprising at least one cutter.

7. The BHA of claim 6, wherein the ramp is configured to engage an arm connected to the at least one cutter to guide the at least one cutter to engage the portion of the tubular of the wellbore.

8. The BHA of claim 1, wherein fluid pumped down coiled tubing connected to the housing causes the at least one tool to move through the opening in the housing.

9. The BHA of claim 1, further comprising a plurality of tools positioned within the interior of the housing, each of the plurality of tools being configured to selectively move from the interior of the housing through an opening in the housing, wherein the ramp is configured to guide each of the plurality of tools to engage a portion of the tubular of the wellbore to create a plurality of holes in the tubular.

10. The BHA of claim 9, wherein the plurality of tools comprises a plurality of mills or a plurality of punch members.

11. A method comprising:

moving at least one tool from an interior of a housing of a bottom hole assembly (BHA) positioned within a wellbore to an exterior of the BHA by pumping fluid down a coiled tubing string to the BHA; guiding the at least one tool with a ramp positioned on a sub connected to the housing of the BHA as the at least one tool moves from the interior to the exterior, wherein the ramp is positioned within an annulus between the BHA and a tubular of the wellbore; and creating at least one hole through the tubular of the wellbore with the at least one tool.

12. The method of claim 11, wherein pumping fluid down the coiled tubing string comprises pumping mud down the coiled tubing string.

13. The method of claim 11, wherein the at least one tool comprises a punch member and creating the at least one hole comprises punching the at least one hole in the tubular with the punch member.

14. The method of claim 13, further comprising pumping fluid through the punch member to a formation of the wellbore through the at least one hole in the tubular.

15. The method of claim 14, further comprising fracturing the formation by pumping fluid through the punch member.

16. The method of claim 11, wherein the at least one tool comprises a mill and creating the at least one hole through the tubular comprises cutting the at least one hole through the tubular with the mill.

17. The method of claim 16, further comprising moving the mill to the interior of the BHA after creating the at least one hole through the tubular.

18. The method of claim 17, further comprising pumping fluid through the at least one hole through the tubular to a formation of the wellbore after moving the mill to the interior of the BHA.

19. A downhole system comprising: a tubing string;

a housing connected to the tubing string, an interior of the housing in fluid communication with an interior of the tubing string;

a plurality of tools, the plurality of tools each being movable between the interior of the housing and an exterior of the housing through an opening in the housing, wherein each of the plurality of tools is configured to create a hole in a tubular of a wellbore; and a sub connected to the housing and having an external ramp, the external ramp being positioned in an annulus between the housing and the tubular of the wellbore and being positioned adjacent to the plurality of tools, the external ramp configured to cause each of the plurality of tools to engage a portion of the tubular as each of the plurality of tools moves from the interior to the exterior of the housing, wherein fluid pumped down the tubing string moves the plurality of tools from the interior of the housing to engage the tubular.

20. The system of claim 19, wherein the plurality of tools comprise a plurality of mills configured to cut holes in the tubular or the plurality of tools comprise a plurality of punch members configured to punch holes in the tubular.

* * * * *